US011713854B2

(12) United States Patent
Qin et al.

(10) Patent No.: US 11,713,854 B2
(45) Date of Patent: Aug. 1, 2023

(54) LIGHTING APPARATUS

(71) Applicant: LEEDARSON LIGHTING CO., LTD., Fujian (CN)

(72) Inventors: Qi Qin, Fujian (CN); Xiaohui Zhong, Fujian (CN); Chunteng Chen, Fujian (CN); Ping Yan, Fujian (CN)

(73) Assignee: LEEDARSON LIGHTING CO., LTD., Fujian (CN)

( * ) Notice: Subject to any disclaimer, the term of this patent is extended or adjusted under 35 U.S.C. 154(b) by 0 days.

(21) Appl. No.: 17/843,564

(22) Filed: Jun. 17, 2022

(65) Prior Publication Data

US 2022/0403990 A1 Dec. 22, 2022

(30) Foreign Application Priority Data

Jun. 17, 2021 (CN) ..... 202121350949.6

(51) Int. Cl.

| | |
|---|---|
| ***F21S 4/28*** | (2016.01) |
| ***F21V 23/04*** | (2006.01) |
| ***F21V 23/00*** | (2015.01) |
| ***F21V 15/01*** | (2006.01) |
| ***F21Y 115/10*** | (2016.01) |
| ***F21V 17/16*** | (2006.01) |
| ***F21V 15/015*** | (2006.01) |

(52) U.S. Cl.

CPC ..... *F21S 4/28* (2016.01); *F21V 15/01* (2013.01); *F21V 23/009* (2013.01); *F21V 23/04* (2013.01); *F21V 15/015* (2013.01); *F21V 17/16* (2013.01); *F21Y 2115/10* (2016.08)

(58) Field of Classification Search

CPC ..... F21S 4/28; F21S 2/005; F21V 23/009

See application file for complete search history.

(56) References Cited

U.S. PATENT DOCUMENTS

| | | | | |
|---|---|---|---|---|
| 2008/0037239 | A1* | 2/2008 | Thomas | F21V 29/83 362/217.05 |
| 2012/0113634 | A1* | 5/2012 | Wong | F21V 23/009 362/249.02 |
| 2018/0087727 | A1* | 3/2018 | Miyahara | F21V 15/01 |
| 2018/0306413 | A1* | 10/2018 | Tremaine | F21V 31/04 |
| 2020/0149716 | A1* | 5/2020 | Collado | F21S 4/28 |

* cited by examiner

*Primary Examiner* — William N Harris

(74) *Attorney, Agent, or Firm* — Chun-Ming Shih; Lanway IPR Services

(57) ABSTRACT

In some embodiments, a lighting apparatus includes a light passing cover, two light bars, a base bracket, two terminal covers, a driver module and an internal cover. The light passing cover is made with a flexible material. The two light bars are disposed on the base plate for generating a light passing through the light passing cover. The base bracket has a base plate and two lateral walls. The base plate has a rectangular shape with two long sides and two short sides. The two lateral walls are disposed at the two long sides of the base plate. The light passing cover is fixed between the two lateral walls when the first external force is removed. The terminal cover has a wiring hole for passing a connecting wire. The connecting wire is connected between the driver module to an external lighting apparatus.

20 Claims, 10 Drawing Sheets

LIGHTING APPARATUS

FIELD

The present invention is related to a lighting apparatus, and more particularly related to a lighting apparatus capable of being connected to other lighting apparatus.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

In past, light devices are usually deployed separately. It causes not only additional install cost but also makes the control more difficult.

Recently, more and more people like to install light devices connected together. It is therefore beneficial to provide a convenient and low cost design that are easily to be connected and configured.

SUMMARY

In some embodiments, a lighting apparatus includes a light passing cover, two light bars, a base bracket, two terminal covers, a driver module and an internal cover.

The light passing cover is made with a flexible material.

The two light bars are disposed on the base plate for generating a light passing through the light passing cover.

The base bracket has a base plate and two lateral walls. The base plate has a rectangular shape with two long sides and two short sides.

The two lateral walls are disposed at the two long sides of the base plate.

The light passing cover is elastically deformed by a first external force to enter a cover space between the two lateral walls and fixed between the two lateral walls when the first external force is removed.

The two terminal covers are disposed at the two short sides of the base plate.

The terminal cover has a wiring hole for passing a connecting wire.

The connecting wire is connected between the driver module to an external lighting apparatus.

The internal cover is attached to the base plate.

The internal cover and the base plate together define a driver space for concealing the driver module.

The internal cover is disposed between the two light bars.

In some embodiments, a length of the internal cover is larger than a length of the light bar.

In some embodiments, a length of the internal cover is identical to a length of the light bar.

In some embodiments, the light bar has a lens cover with multiple lenses respectively covering multiple LED modules of the light bar.

The lens cover is detachable to be replaced with another lens cover.

In some embodiments, the driver module has a driver box for containing a driver circuit for converting an external power to a driving current supplied to the two light bars.

In some embodiments, the base plate and the internal cover are both made of metal material to prevent fire accident of the driver module to extend outside the driver space.

In some embodiments, the internal cover has a reflective layer facing to the two light bars for reflecting the light toward the light passing cover.

In some embodiments, two elongated platforms are protruding from the base plate for respectively supporting the two light bars to keep the light bar higher than the internal cover with respect to the base plate.

In some embodiments, the internal cover is elastically deformed with a second external force to insert into an internal cover space between the two elongated platforms and fixed between the two elongated platforms when the second external force is removed.

In some embodiments, two end covers are disposed on two sides of the internal cover to conceal the driver if the lighting apparatus is not connected to another lighting apparatus via the wiring hole.

In some embodiments, the end cover is detachable from the internal cover with a punching force.

In some embodiments, the terminal cover has a detachable wiring plate for selectively concealing the wiring hole or exposing the wiring hole.

In some embodiments, a first height between a top of the internal cover to the base plate is smaller than a diameter of a wiring head placed inside the light passing cover but outside the internal cover.

In some embodiments, two edges of the light passing respectively engages by top edges of the two terminal covers to fix the light passing cover to the base bracket.

In some embodiments, the internal cover has an external wiring groove for collecting a wire component.

In some embodiments, the external groove is formed with a elongated reverse edge of the internal cover.

In some embodiments, the driver module has a manual switch for setting a configuration.

In some embodiments, the configuration includes a grouping identifier of the lighting apparatus.

The driver module determines whether to respond to an external control signal received via the connecting wire according to the grouping identifier.

In some embodiments, the driver module generates an external command transmitted to another lighting apparatus connected to the lighting apparatus via the connecting wire to control said another lighting apparatus.

In some embodiments, the driver module shares a sensor signal with other lighting apparatus via the connecting wire.

DETAILED DESCRIPTION

Figure 9:
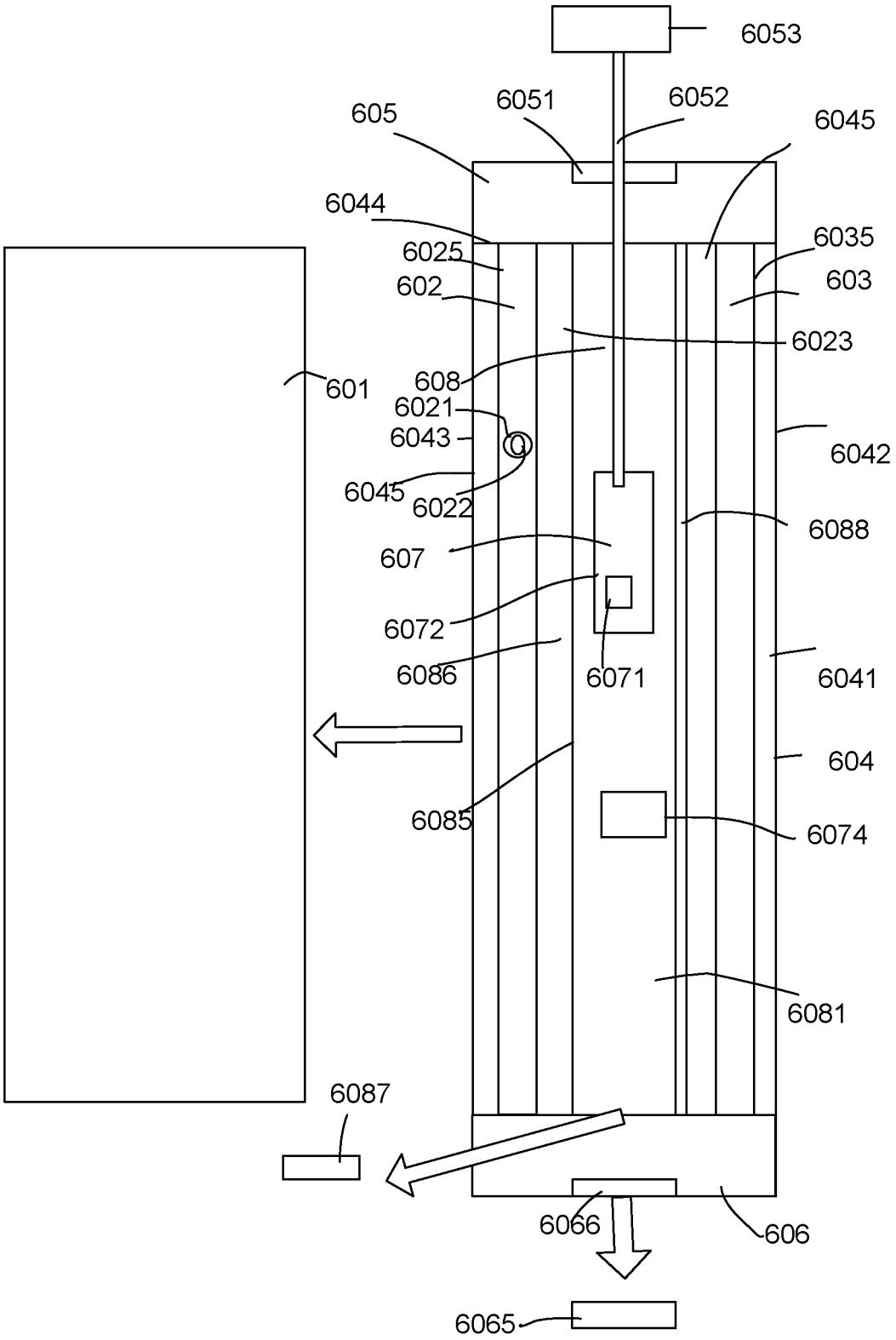
FIG. 9 shows another embodiment of a lighting apparatus.

Please refer to FIG. 9, which shows a lighting apparatus embodiment. In some embodiments, a lighting apparatus includes a light passing cover 601, two light bars 602, 603, a base bracket 604, two terminal covers 605, 606, a driver module 607 and an internal cover 608.

The light passing cover 601 is made with a flexible material, e.g. a plastic material that is capable of being bent or deformed. In addition, the light passing cover may include lens, diffusing layer or other optical features.

The two light bars 602, 603 are disposed on the base plate 6041 for generating a light passing through the light passing cover 601.

The base bracket has a base plate 6041 and two lateral walls 6042, 6043. The base plate 6041 has a rectangular shape with two long sides 6045 and two short sides 6044.

The two lateral walls 6042, 6043 are disposed at the two long sides 6044 of the base plate 6041.

The light passing cover 601 is elastically deformed by a first external force to enter a cover space 6045 between the two lateral walls 6042, 6043 and fixed between the two lateral walls 6042, 6043 when the first external force is removed.

In other words, no screws may be needed for attaching the light passing cover to the base bracket. This saves assembly time and simplifies the complexity of installing the lighting apparatus. Some buckles, grooves and/or protruding blocks may be used to further enhance fixing reliability.

The two terminal covers 605, 606 are disposed at the two short sides 6044 of the base plate 6041.

The terminal cover 605 has a wiring hole 6051 for passing a connecting wire 6052.

The connecting wire 6052 is connected between the driver module 607 and an external lighting apparatus 6053. The external lighting apparatus 6053 may be a similar lighting apparatus as the lighting apparatus in FIG. 9.

The internal cover 608 is attached to the base plate 6041.

The internal cover 608 and the base plate 6041 together define a driver space 6081 for concealing the driver module 607.

The internal cover 608 is disposed between the two light bars 602, 603.

In some embodiments, a length of the internal cover 608 is larger than a length of the light bar 602. In such case, the components and wires of the driver module are concealed by the internal cover 608.

In some embodiments, a length of the internal cover 608 is identical to a length of the light bar 602. In such case, the light bar 602 extends from one end to another end of the base bracket.

In some embodiments, the light bar 602 has a lens cover 6023 with multiple lenses 6021 respectively covering multiple LED modules 6022 of the light bar.

The lens cover 6023 is detachable to be replaced with another lens cover. For example, different lens cover are disposed with different lenses corresponding to different light span angles.

In some embodiments, the driver module 607 has a driver box 6072 for containing a driver circuit 6071 for converting an external power to a driving current supplied to the two light bars 602, 603.

In some embodiments, the base plate 6041 and the internal cover 608 are both made of metal material to prevent fire accident of the driver module to extend outside the driver space. In other words, the internal cover 608 and the base plate 6041 form a metal container. If the driver circuit 6071 is short and causes a fire accident, the fire accident is kept inside the metal container for at least a desired time period.

In some embodiments, the internal cover 608 has a reflective layer 6085 facing to the two light bars 602, 603 for reflecting the light toward the light passing cover 601.

In FIG. 9, the light passing cover 601 is detached from the base bracket to illustrate more components in this example.

In some embodiments, two elongated platforms 6025, 6035 are protruding from the base plate 6041 for respectively supporting the two light bars 602, 603 to keep the light bars higher than the internal cover 608 with respect to the base plate 6041.

The elongated platforms 6025, 6035 are below the light bars 602, 603 and may be made as parts of the base bracket. For example, when the base bracket is made of metal material, the two elongated platforms 6025, 6035 may be made by stamping a metal sheet that is used for making the base bracket.

In some embodiments, the internal cover is elastically deformed with a second external force to insert into an internal cover space 6086 between the two elongated platforms 6025, 6035 and fixed between the two elongated platforms 6025, 6035 when the second external force is removed. Like the light passing cover mentioned above, additional grooves, tracks or blocks may be used for make the attachment more reliable.

In some embodiments, two end covers 6087 are disposed on two sides of the internal cover 608 to conceal the driver module 607 if the lighting apparatus is not connected to another lighting apparatus via the wiring hole.

In some embodiments, the end cover 6087 is detachable from the internal cover 608 with a punching force. For example, the end cover 6087 may be kept attaching to the internal cover 608 if the lighting apparatus is not attached to other lighting apparatus. The end cover 6087 may be detached for allowing wires to be inserted and connected to the driver module 607.

In some embodiments, the terminal cover 606 has a detachable wiring plate 6065 for selectively concealing the wiring hole 6066 or exposing the wiring hole 6066.

Figure 10:
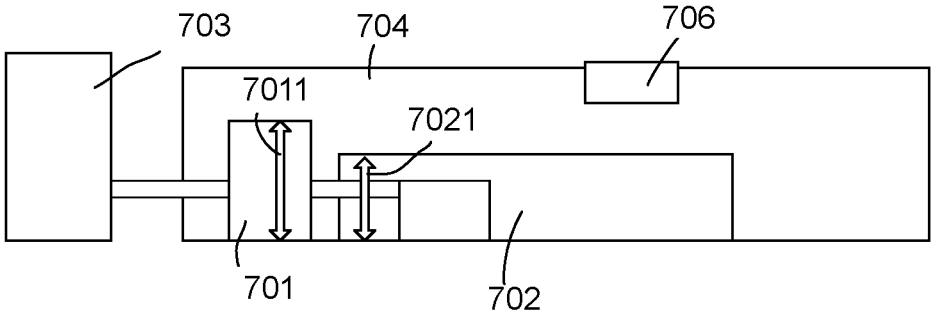
FIG. 10 shows multiple lighting apparatuses are connected to be controlled together.

In FIG. 10, a first height 7021 between a top of the internal cover 702 to the base plate is smaller than a diameter 7011 of a wiring head 701 placed inside the light passing cover 704 but outside the internal cover 702.

Figure 5:
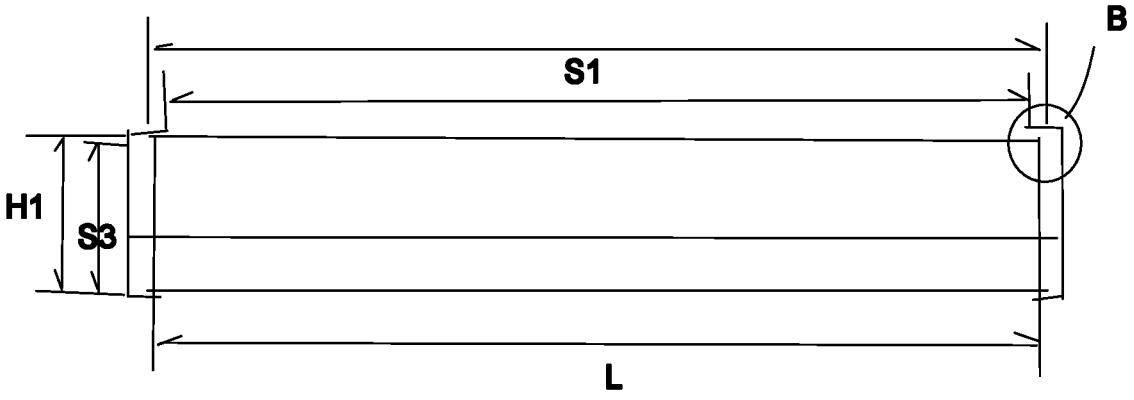
FIG. 5 illustrates a relative size diagram of an example.
Figure 6:
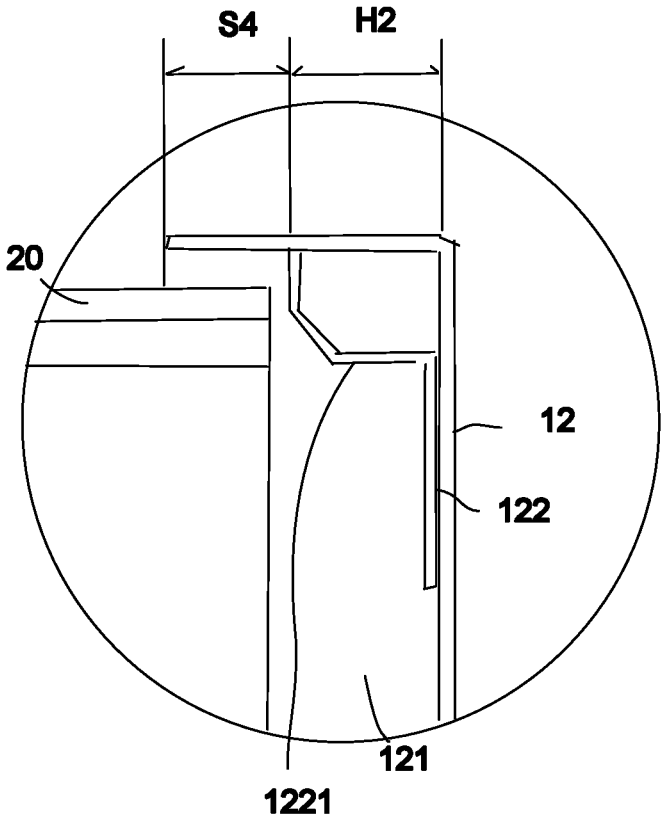
FIG. 6 illustrates a zoom-up view of a a part of the example in FIG. 5.

In some embodiments, two edges of the light passing respectively engages by top edges of the two terminal covers to fix the light passing cover to the base bracket, as illustrated in FIG. 5 and FIG. 6, which are explained in further detail as follows.

Figure 7:
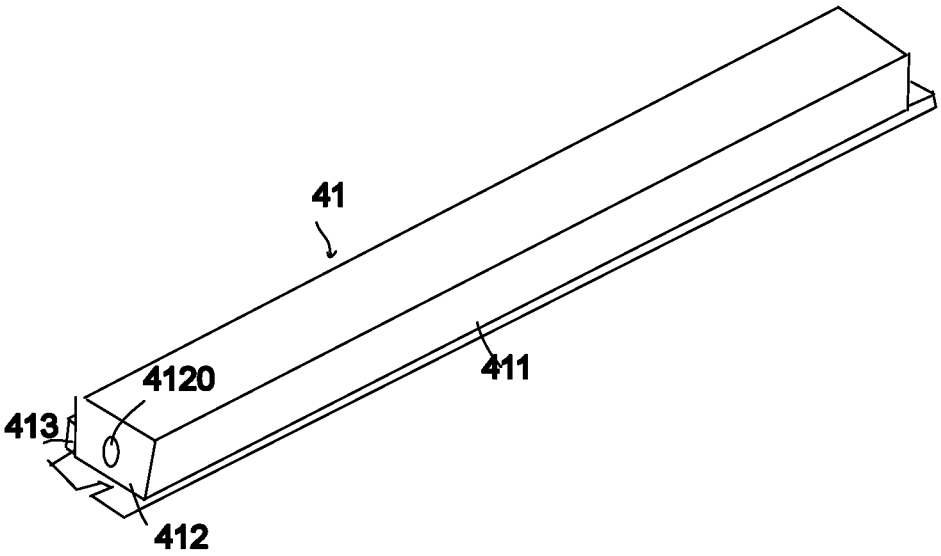
FIG. 7 illustrates an example of an internal cover.

In FIG. 9, the internal cover 608 has an external wiring groove 6088 for collecting a wire component. This feature is also illustrated in FIG. 7. In FIG. 7, the internal cover 41 has a wiring groove 413.

Figure 8:
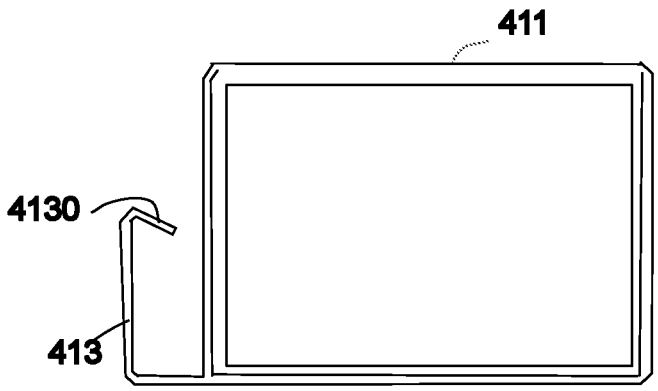
FIG. 8 illustrates another view of the example in FIG. 7.

In some embodiments, the external groove is formed with a elongated reverse edge of the internal cover. FIG. 8 shows the guiding groove 413 is formed with a reverse edge 4130 of the internal cover 411.

In FIG. 9, the driver module 607 has a manual switch 6074 for setting a configuration. The manual switch 6074 may include one or more buttons, touch switches, dip switches or other operable devices for setting a parameter for instructing the driver module 607 to operate.

For example, the parameter may be the color temperature to be mixed by the LED modules on the two light bars.

In some embodiments, the configuration includes a grouping identifier of the lighting apparatus. The grouping identifier refers to an electronic setting or a mechanical status that corresponds to a group. A group may include multiple lighting apparatuses as described above.

These lighting apparatuses may be connected together as mentioned above. In some use case, lighting apparatuses may be divided into multiple groups, e.g. different zones in an office.

For example, twelve connected lighting apparatuses may be divided into three groups depending on areas of the lighting apparatuses. Users may operate the manual switch to identify which group lighting apparatus belongs to, e.g. group A, group B or group C.

After such setting, users may send a control command of group A to all connected lighting apparatuses. Only lighting apparatuses in group A responds to the control command, e.g. to turn on.

The driver module determines whether to respond to an external control signal received via the connecting wire according to the grouping identifier.

In some embodiments, the driver module generates an external command transmitted to another lighting apparatus connected to the lighting apparatus via the connecting wire to control said another lighting apparatus.

In some embodiments, the driver module shares a sensor signal with other lighting apparatus via the connecting wire.

For example, a sensor 706 in FIG. 10 detects ambient light level and such information is forwarded to a connected lighting apparatus 703 to share with the lighting apparatus 703.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

Figure 1:
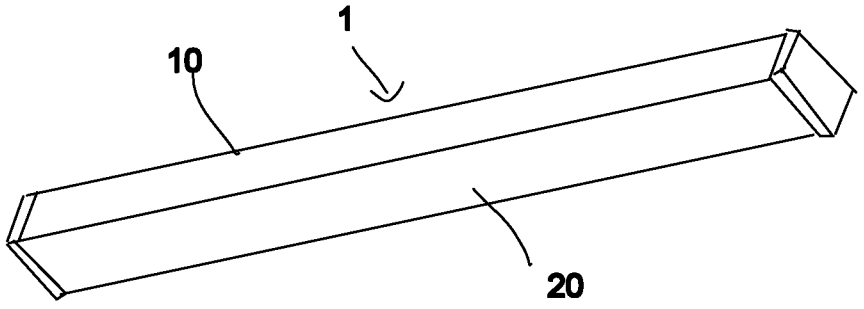
FIG. 1 illustrates a lighting apparatus embodiment.

FIG. 1 shows a lighting apparatus 1 embodiment. The lighting apparatus 1 has a base bracket 10 and a light passing cover 20.

Figure 2:
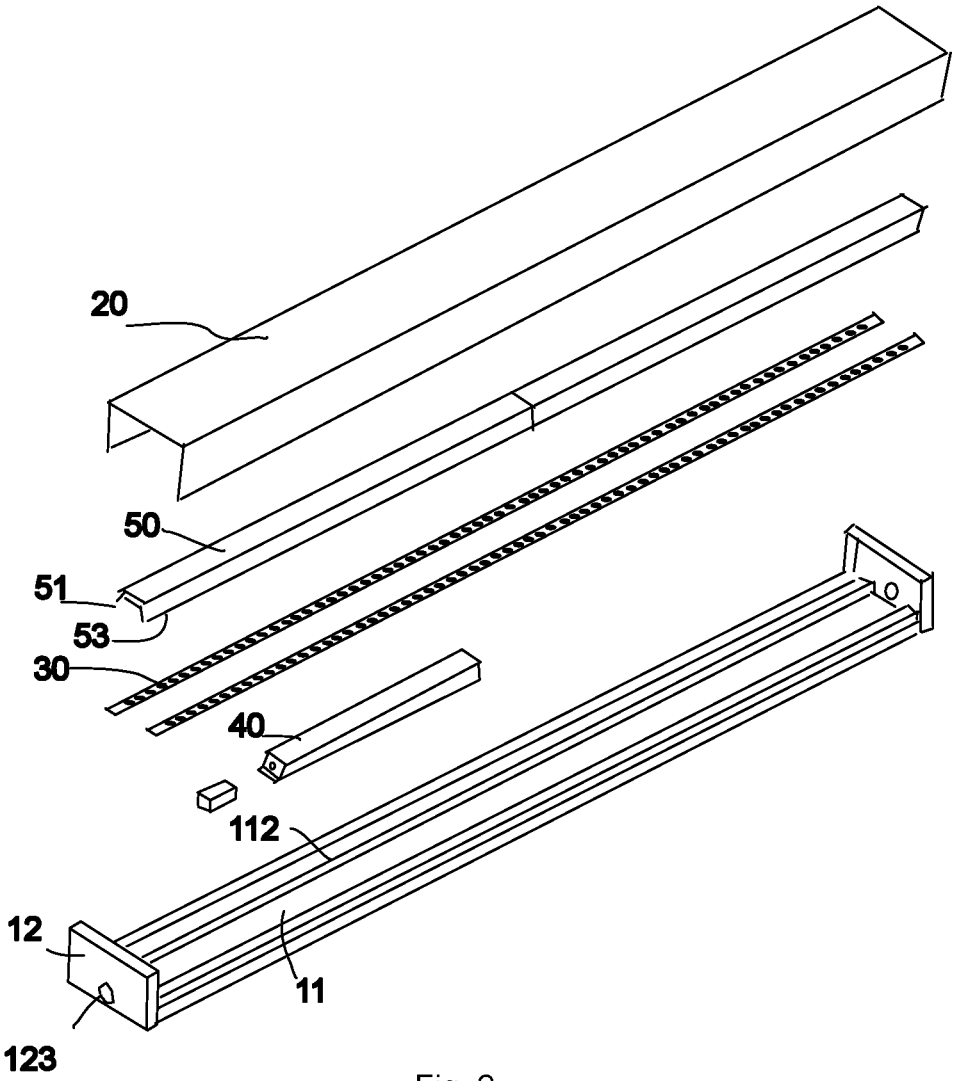
FIG. 2 illustrates an exploded view of a lighting apparatus.

FIG. 2 shows an exploded view of the example in FIG. 1. In following description, the same reference numerals refer to the same components. If they are described in some view of an example, they may be skipped when describing another drawing for brevity.

In FIG. 2, the light passing cover 20 has a U shape structure. There is an internal cover 50 as described above.

The internal cover 50 has an escape hole 51 and a reverse edge 53. There are two light bars 30 for emitting a light to pass through the light passing cover 20.

There is a driver module 40 to be stored inside the internal cover 50.

There are two elongated platforms 112, which may be protruding bars extending from the base plate 11. The base bracket has two terminal covers 12. The terminal cover 12 has a wiring hole 123.

Figure 3:
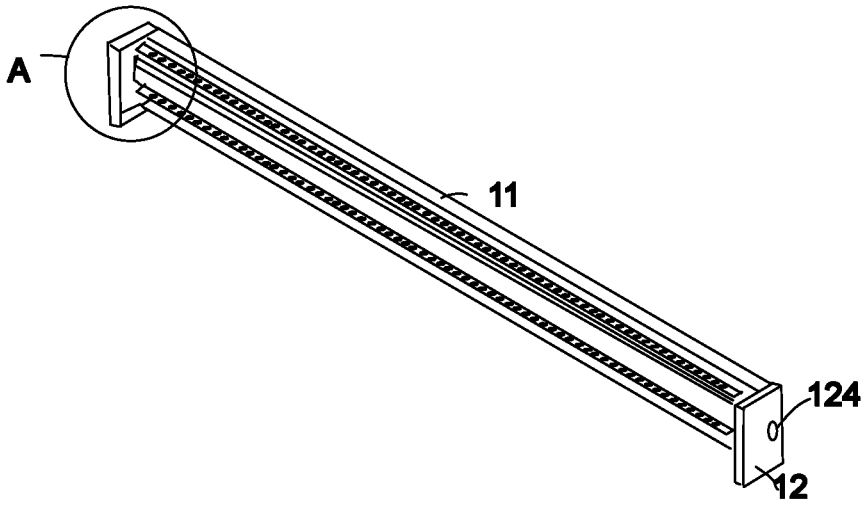
FIG. 3 illustrates an example without a light passing cover.

FIG. 3 shows a portion of components. In FIG. 3, two terminal covers 12 with wiring holes 124 are disposed on two sides of the base plate 11.

Figure 4:
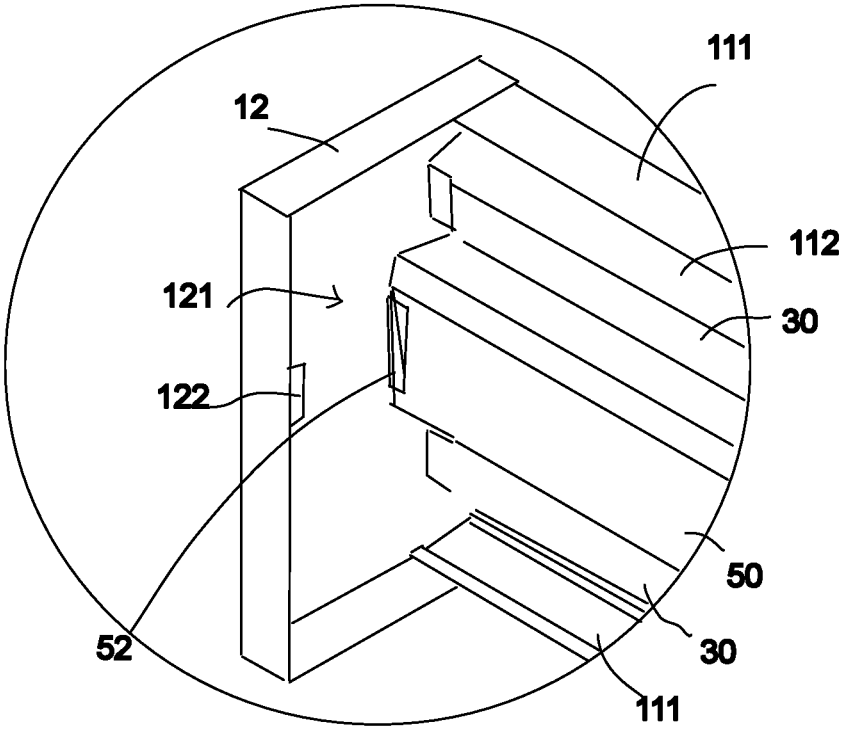
FIG. 4 illustrates a zoom-up view of a part of the example in FIG. 3.

FIG. 4 shows a zoom-up view of the example in FIG. 3.

In FIG. 4, there is an installation groove 121 defined by the terminal cover 12 to install the light bars 30 and the internal cover 50. The base bracket has two lateral walls 111. The internal cover 50 has two end covers 52 on two sides that may be detached from the internal cover 50. A position limiter 122 may be used for aligning and installing components.

FIG. 5 shows a size diagram among components. S1 refers to two top edges of terminal covers at two sides of a base bracket. L refers to a length of the light passing cover. L is larger than S1. In such arrangement, the light passing cover is deformed by applying an external force to insert into the terminal covers. When the external force is removed, the light passing cover recovers its length of L, which is larger than S1, and thus is kept attached to the base bracket.

There are two blocks with length S1, which is slightly larger than L for keeping the light passing cover more stable.

The container defined by the base bracket has a height S3, which is slightly smaller than the height H1 of the light passing cover, which also helps keep the light passing cover to attach to the base bracket.

FIG. 6 is zoom-up view of area B in FIG. 5. In FIG. 6, the block 1221 of the terminal cover 12 helps keep the light passing cover 20 to stay in the container space 121. The size S4 and H2 show component arrangement which can be modified in different designs.

FIG. 7 shows an example of an internal cover 41. The internal cover 41 has a housing with a reverse edge 4130. There is a wiring hole 4120 and an end cover 412.

FIG. 8 shows another view of the example in FIG. 8, which is described above.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light passing cover made with a flexible material;

a base bracket with a base plate and two lateral walls, wherein the two lateral walls are disposed at two long sides of the base plate, wherein the light passing cover is elastically deformed by a first external force to enter a cover space between the two lateral walls and fixed between the two lateral walls when the first external force is removed;

two light bars disposed on the base bracket for generating a light passing through the light passing cover;

a driver module;

two terminal covers disposed at two short sides of the base plate, wherein at least one of the terminal covers has a wiring hole for passing a connecting wire, wherein the connecting wire is connected between the driver module to an external lighting apparatus;

and an internal cover attached to the base plate, wherein the internal cover and the base plate together define a driver space for concealing the driver module, wherein the internal cover is disposed between the two light bars.

2. The lighting apparatus of claim 1, wherein a length of the internal cover is larger than a length of the light bar.

3. The lighting apparatus of claim 1, wherein a length of the internal cover is identical to a length of the light bar.

4. The lighting apparatus of claim 1, wherein the light bar has a lens cover with multiple lenses respectively covering multiple LED modules of the light bar, wherein the lens cover is detachable to be replaced with another lens cover.

5. The lighting apparatus of claim 1, wherein the driver module has a driver box for containing a driver circuit.

6. The lighting apparatus of claim 5, wherein the base plate and the internal cover are both made of metal material to prevent a fire accident of the driver module from extending outside the driver space.

7. The lighting apparatus of claim 6, wherein the internal cover has a reflective layer facing to the two light bars for reflecting the light toward the light passing cover.

8. The lighting apparatus of claim 1, wherein two elongated platforms are protruding from the base plate for respectively supporting the two light bars to keep the light bar higher than the internal cover with respect to the base plate.

9. The lighting apparatus of claim 8, wherein the internal cover is elastically deformed with a second external force to insert into an internal cover space between the two elongated platforms and fixed between the two elongated platforms when the second external force is removed.

10. The lighting apparatus of claim 1, wherein two end covers are disposed on two sides of the internal cover to conceal the driver if the lighting apparatus is not connected to another lighting apparatus via the wiring hole.

11. The lighting apparatus of claim 10, wherein the end cover is detachable from the internal cover with a punching force.

12. The lighting apparatus of claim 1, wherein the terminal cover has a detachable wiring plate for selectively concealing the wiring hole or exposing the wiring hole.

13. The lighting apparatus of claim 1, wherein a first height between a top of the internal cover to the base plate is smaller than a diameter of a wiring head placed inside the light passing cover but outside the internal cover.

14. The lighting apparatus of claim 1, wherein two edges of the light passing covers are respectively engaged by top edges of the two terminal covers to fix the light passing cover to the base bracket.

15. The lighting apparatus of claim 1, wherein the internal cover has an external wiring groove for collecting a wire component.

16. The lighting apparatus of claim 15, wherein the external groove is formed with an elongated reverse edge of the internal cover.

17. The lighting apparatus of claim 1, wherein the driver module has a manual switch for setting a configuration.

18. The lighting apparatus of claim 17, wherein the configuration comprises a grouping identifier of the lighting apparatus, wherein the driver module determines whether to respond to an external control signal received via the connecting wire according to the grouping identifier.

19. The lighting apparatus of claim 18, wherein the driver module generates an external command transmitted to another lighting apparatus connected to the lighting apparatus via the connecting wire to control said another lighting apparatus.

20. The lighting apparatus of claim 1, wherein the driver module shares a sensor signal with another lighting apparatus via the connecting wire.

* * * * *